US009871327B2

(12) United States Patent
Simmel et al.

(10) Patent No.: US 9,871,327 B2
(45) Date of Patent: Jan. 16, 2018

(54) DUAL CONNECTOR HAVING GROUND PLANES IN TONGUES

(71) Applicant: Apple Inc., Cupertino, CA (US)

(72) Inventors: George Marc Simmel, Cupertino, CA (US); Zheng Gao, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/636,021

(22) Filed: Mar. 2, 2015

(65) Prior Publication Data

US 2015/0214674 A1 Jul. 30, 2015

Related U.S. Application Data

(63) Continuation of application No. 13/492,891, filed on Jun. 10, 2012, now Pat. No. 8,968,031.

(51) Int. Cl.

| | |
|---|---|
| ***H01R 13/648*** | (2006.01) |
| ***H01R 13/6597*** | (2011.01) |
| ***H01R 13/659*** | (2011.01) |
| ***H01R 13/6594*** | (2011.01) |
| ***H01R 24/60*** | (2011.01) |
| *H01R 107/00* | (2006.01) |

(52) U.S. Cl.

CPC ..... *H01R 13/6597* (2013.01); *H01R 13/659* (2013.01); *H01R 13/6594* (2013.01); *H01R 24/60* (2013.01); *H01R 2107/00* (2013.01)

(58) Field of Classification Search

CPC ..... H01R 23/7073; H01R 23/6873; H01R 23/688; H01R 13/658; H01R 13/26

USPC ..... 439/660, 607.35, 607.4, 108

See application file for complete search history.

(56) References Cited

U.S. PATENT DOCUMENTS

| | | | | |
|---|---|---|---|---|
| 4,824,383 | A | 4/1989 | Lemke | |
| 7,179,127 | B2 | 2/2007 | Shiu | |
| 7,731,535 | B1 * | 6/2010 | Wan | H01R 12/712 439/541.5 |
| 7,758,379 | B2 | 7/2010 | Chen | |
| 7,811,110 | B2 * | 10/2010 | He | H01R 13/405 439/218 |

(Continued)

OTHER PUBLICATIONS

Non-Final Office Action dated Apr. 7, 2014 for U.S. Appl. No. 13/492,891, 7 pages.

(Continued)

*Primary Examiner* — Hien Vu

(74) *Attorney, Agent, or Firm* — Kilpatrick Townsend & Stockton, LLP

(57) ABSTRACT

Connector receptacle assemblies that may be simple to manufacture, provide multiple receptacles, and provide a good ground contact path. One example may provide a connector receptacle assembly formed of a housing having a tongue that may include openings on one or more sides for contacts as well as openings on its sides for ground contacts. Another example may provide a connector receptacle assembly having at least two tongues, where each tongue may be aligned with a corresponding opening in a device enclosure. Another example may provide a connector receptacle assembly having a tongue with a center ground contact, where the center ground contact may be located between the top row and the bottom row of contacts. Another example may provide a connector receptacle assembly having a titanium-copper center ground contact.

20 Claims, 19 Drawing Sheets

(56) References Cited

U.S. PATENT DOCUMENTS

| | | | | |
|---|---|---|---|---|
| 7,837,499 | B1 * | 11/2010 | Chen | H01R 12/712 439/541.5 |
| 7,922,534 | B2 | 4/2011 | Lin et al. | |
| 7,997,927 | B2 * | 8/2011 | Wan | H01R 12/724 439/541.5 |
| 8,109,795 | B2 | 2/2012 | Lin et al. | |
| 8,337,253 | B2 | 12/2012 | Gao et al. | |
| 8,535,069 | B2 | 9/2013 | Zhang | |
| 8,568,171 | B2 * | 10/2013 | Yang | H01R 13/502 439/607.27 |
| 8,968,031 | B2 | 3/2015 | Simmel et al. | |
| 2009/0093166 | A1 | 4/2009 | Fogg et al. | |

OTHER PUBLICATIONS

Notice of Allowance dated Oct. 15, 2014 for U.S. Appl. No. 13/492,891, 12 pages.

* cited by examiner

DUAL CONNECTOR HAVING GROUND PLANES IN TONGUES

CROSS-REFERENCES TO RELATED APPLICATIONS

This application is a continuation of U.S. patent application Ser. No. 13/492,891, filed Jun. 10, 2012, which is incorporated by reference.

BACKGROUND

The number and types of electronic devices available to consumers have increased tremendously the past few years, and this increase shows no signs of abating. Devices such as portable computing devices, tablet, desktop, and all-in-one computers, cell, smart, and media phones, storage devices, portable media players, navigation systems, monitors and other devices have become ubiquitous.

These devices often receive and provide power and data using various cable assemblies. These cable assemblies may include connector inserts, or plugs, on one or more ends of a cable. The connector inserts may plug into connector receptacles on electronic devices, thereby forming one or more conductive paths for signals and power. These connections may be made several thousands of times during the lifetime of a device. Accordingly, it may be desirable that these receptacles be durable.

The connector receptacles may be formed of housings that typically at least partially surround, and provide mechanical support for, a number of contacts. These contacts may be arranged to mate with corresponding contacts on the connector inserts or plugs to form portions of electrical paths between devices.

The numbers of these receptacles that are manufactured for some electronic devices can be very large. Accordingly, it may be desirable to provide connector receptacles that are simple to assemble and manufacture. It may also be desirable to provide assemblies that can be used for multiple receptacles.

As a further complication, the data rates of some signals conveyed by these connector receptacles have increased over time. To be able to handle these signals, it may be desirable that the connector receptacles do not degrade signal quality significantly. An important aspect of providing good signal quality is to provide good ground isolation and shielding for the connector receptacle and corresponding connector insert. Accordingly, it may be desirable to provide connector receptacles that provide good ground isolation and shielding.

Thus, what is needed are connector receptacle assemblies that are simple to manufacture, provide multiple receptacles, provide a good ground isolations and shielding, and are durable.

SUMMARY

Accordingly, embodiments of the present invention may provide connector receptacle assemblies that may be simple to manufacture, provide multiple receptacles, and provide good ground isolation and shielding.

An illustrative embodiment of the present invention may provide a connector receptacle that is simple to assemble. A specific embodiment of the present invention provides a connector receptacle assembly that includes a housing having a tongue. The tongue may include openings on a top or bottom, or both, for contacts. The tongue may include openings on its sides for ground contacts. The housing may be partially enclosed by a shield. The housing or shield, or both, may be fixed to a main logic board, motherboard, or other appropriate substrate. The tongue may be aligned with an opening in a device enclosure. One or more retention features may be included as part of, or attached to, the housing, device enclosure, or both. For example, a ground contact may be formed in either or both a top and bottom of an opening in a device enclosure. In another example, ground contacts that may also provide retention may be attached to, or formed as part of a shield attached to the housing.

Another illustrative embodiment of the present invention may provide a connector receptacle assembly that may be used for multiple connector receptacles. A specific embodiment of the present invention may provide a connector receptacle assembly having at least two tongues. Each tongue may be aligned with a corresponding opening in a device enclosure. By providing a housing with two or more tongues, spacing and vertical alignment between the tongues may be more accurately controlled than if two or more separate housings having individual tongues are provided. This may aid in providing an electronic device having a desirable appearance and improved manufacturability. That is, by providing two receptacle tongues on a common housing, the tongues are registered to each other directly. This may have less error than each tongue being on a separate housing, each housing fixed to a printed circuit board or other appropriate substrate.

Another illustrative embodiment of the present invention may provide a connector receptacle assembly that may provide good ground isolation and shielding. A specific embodiment of the present invention may provide a connector receptacle assembly having a tongue with a center ground contact. The tongue may have a top row of contacts and a bottom row of contacts. The center ground contact may be located between the top row and the bottom row of contacts. This center ground contact may isolate the top row of contacts from the bottom row of contacts. The center contact may include protrusions for side contacts on each side of the tongue. Individual contacts in the top and bottom rows may also be grounded for further shielding. A shield may at least partially surround a housing of the connector receptacle assembly. The shield may further contact the center ground contact. In this way, signals, such as differential pair signals, may be placed on adjoining contacts that are surrounded on each side by a ground contact, on a top by a shield, and on a bottom by a center ground contact. This may protect these signals from crosstalk from nearby signals and from electromagnetic interference from other signals or circuits. Furthermore, this electrical isolation may protect other signals and circuits from interference caused by the isolated signals.

Another illustrative embodiment of the present invention may provide a connector receptacle assembly that may provide a durable connector receptacle. A specific embodiment of the present invention may provide a connector receptacle assembly having a titanium-copper center ground contact. By using titanium-copper, side ground contacts protruding from the center ground contact may be made more durable, and therefore the connector receptacle may be made to be longer-lasting. Titanium copper may also provide better retention of an inserted connector insert as compared to stainless steel or other material. An electrical connection to a stainless-steel shield may be made using mechanical means, for example, by bending portions of the shield such that contact to the center contact is maintained.

Embodiments of the present invention may be used to improve various connector receptacles, such as those compatible with DisplayPort, Thunderbolt, the various Universal Serial Bus interfaces and standards, including USB, USB2, and USB3, as well as High-Definition Multimedia Interface (HDMI), Digital Visual Interface (DVI), power, Ethernet, and other types of interfaces and standards. These connector receptacles may be utilized in many types of devices, such as portable computing devices, tablet, desktop, and all-in-one computers, cell, smart, and media phones, storage devices, portable media players, navigation systems, monitors and other devices.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
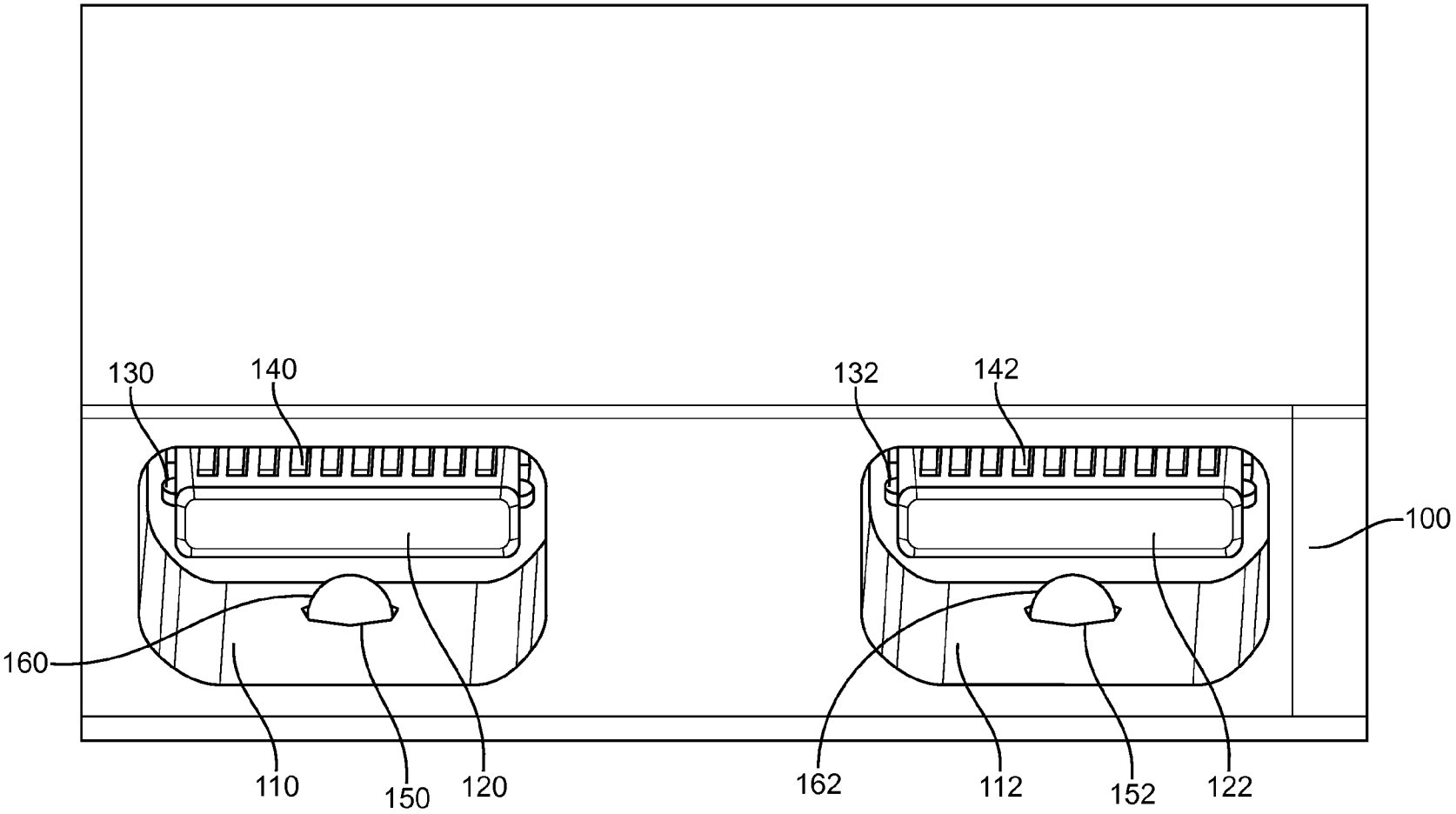
FIG. 1 illustrates a portion of an electronic system according to an embodiment of the present invention.

FIG. 1 illustrates a portion of an electronic system according to an embodiment of the present invention. This figure, as with the other included figures, is shown for illustrative purposes and does not limit either the possible embodiments of the present invention or the claims.

This figure shows a portion of an electronic device having connector receptacles 110 and 112 located in device housing 100. Connector receptacles 110 and 112 may include tongues 120 and 122 having contacts 140 and 142. Tongues 120 and 122 may further include other openings for other contacts, including ground contacts 130 and 132, and contacts on a bottom side (not shown).

Side ground contacts 130 and 132 may provide ground and retention for connector inserts when inserted in connector receptacles 110 and 112. Other ground or retention features may be included on tongues 120 and 122. Further, other ground or retention features may be included in device enclosure 100, such as ground contacts 150 and 152. Specifically, ground contacts 150 and 152 may be located in openings 160 and 162 in device enclosure 100. Ground contacts 150 and 152 may provide ground and retention for connector inserts when inserted in connector receptacles 110 and 112.

In this specific example, connector receptacles 110 and 112 may be Thunderbolt or DisplayPort connector receptacles. In other embodiments of the present invention, other types of connector receptacles may be improved by the incorporation of embodiments of the present invention. These may include the various USB standards, as well as High-Definition Multimedia Interface (HDMI), Digital Visual Interface (DVI), power, Ethernet, and other types of interfaces and standards.

Device housing 100 may be representative of many types of devices, such as portable computing devices, tablet, desktop, and all-in-one computers, cell, smart, and media phones, storage devices, portable media players, navigation systems, monitors and other devices.

Figure 2:
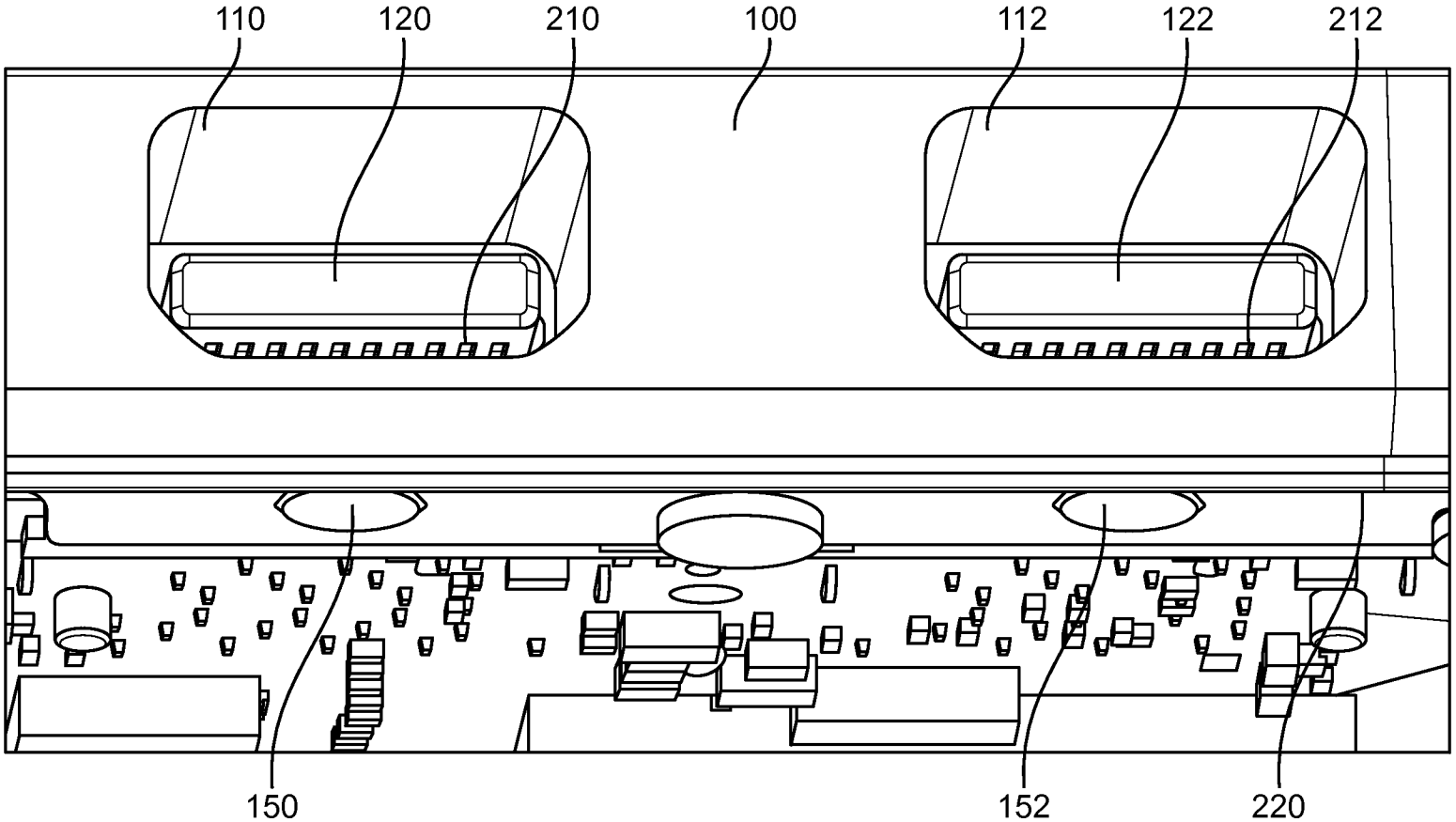
FIG. 2 illustrates another view of an electronic device according to an embodiment of the present invention.

FIG. 2 illustrates another view of an electronic device according to an embodiment of the present invention. Two connector receptacles 110 and 112 may be located in device enclosure 100. Connector receptacles 110 and 112 may include tongues 120 and 122. Contacts 210 and 212 may be located on tongues 120 and 122. Ground contacts 150 and 152 may be located in printed circuit board or other substrate 220.

Again, electronic devices may include multiple connector receptacles. To simplify assembly of these electronic devices, embodiments of the present invention may provide assemblies or components that may be used to provide more than one connector receptacle. For example, embodiments of the present invention may provide components or assemblies that may be used for two or more connector receptacles. An example is shown in the following figure.

Figure 3:
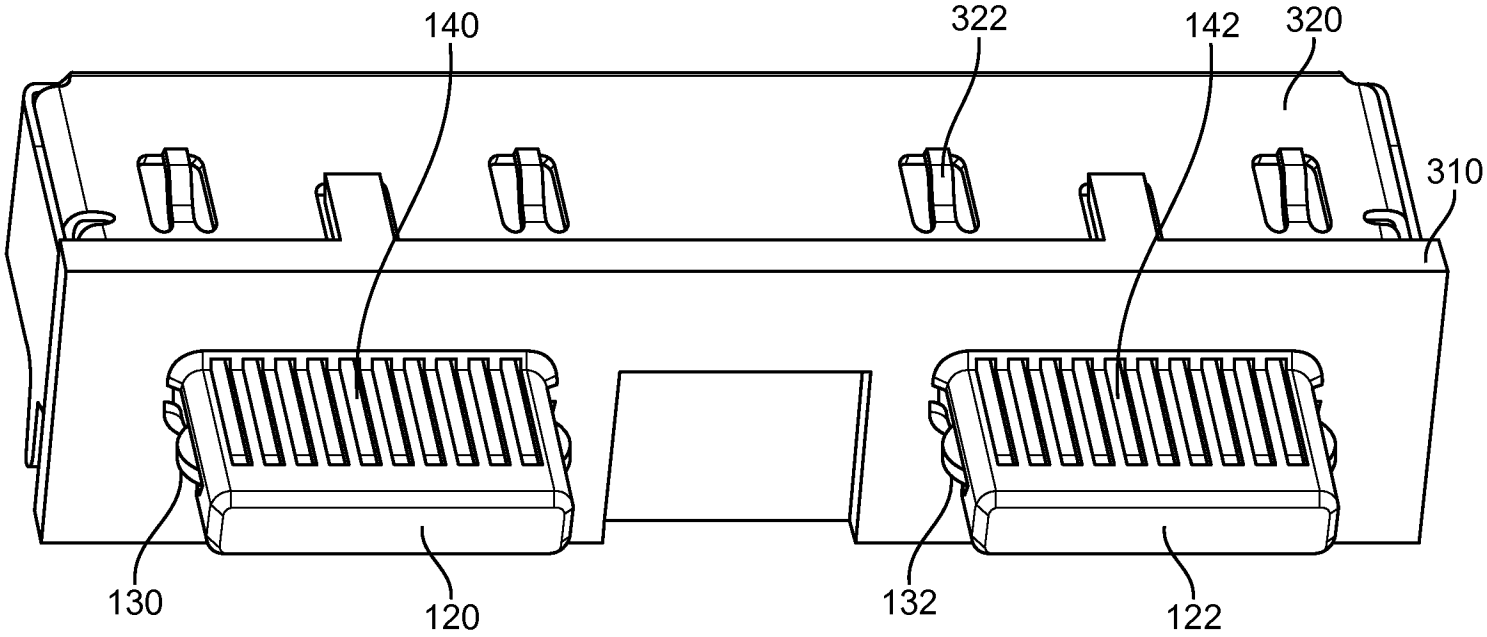
FIG. 3 illustrates a connector receptacle assembly according to an embodiment of the present invention.

FIG. 3 illustrates a connector receptacle assembly according to an embodiment of the present invention. This connector receptacle assembly may include a housing 310 having tongues 120 and 122. Tongues 120 and 122 may include contacts 140 and 142 on a top side, and other contacts (not shown) on a bottom side. Tongues 120 and 122 may further include side ground contacts 130 and 132. Shell 320 may partially surrounded at least a top and back of housing 310. Shell 320 may include fingers 322 for contacting a device enclosure. Fingers 322 may be used for mechanical purposes, that is, to provide stability for a connector receptacle assembly. Fingers 322 may also form electrical connections with device enclosure for electromechanical interference and grounding purposes.

By providing tongues 120 and 122 as part of single housing 310, spacing and alignment between tongues 120 and 122 may be well-controlled. This may allow tongues 120 and 22 to be accurately aligned to openings in a device enclosure, as is shown in FIG. 1 and FIG. 2. This in turn may provide an improved appearance and functionality since tongues 120 and 22 may be accurately aligned in these openings. Also, using a single connector receptacle assembly may simplify assembly of the electronic device, since only one housing is used for to connector receptacles instead of the usual two.

Again, while in this embodiment of the present invention two connector receptacle tongues 120 and 122 are formed on a single housing 310, in other embodiments of the present invention, one, three, or more than three tongues may be formed on a single housing. Also, while tongues 120 and 122 are shown as being adjacent and parallel to each other, in other embodiments the present invention, these tongues may be at ninety degree or other angles with each other. For example, embodiments of the present invention may provide a connector receptacle assembly having two tongues at right angles, where the connector receptacle assembly is arranged to be located in a corner of an electronic device.

Figure 4:
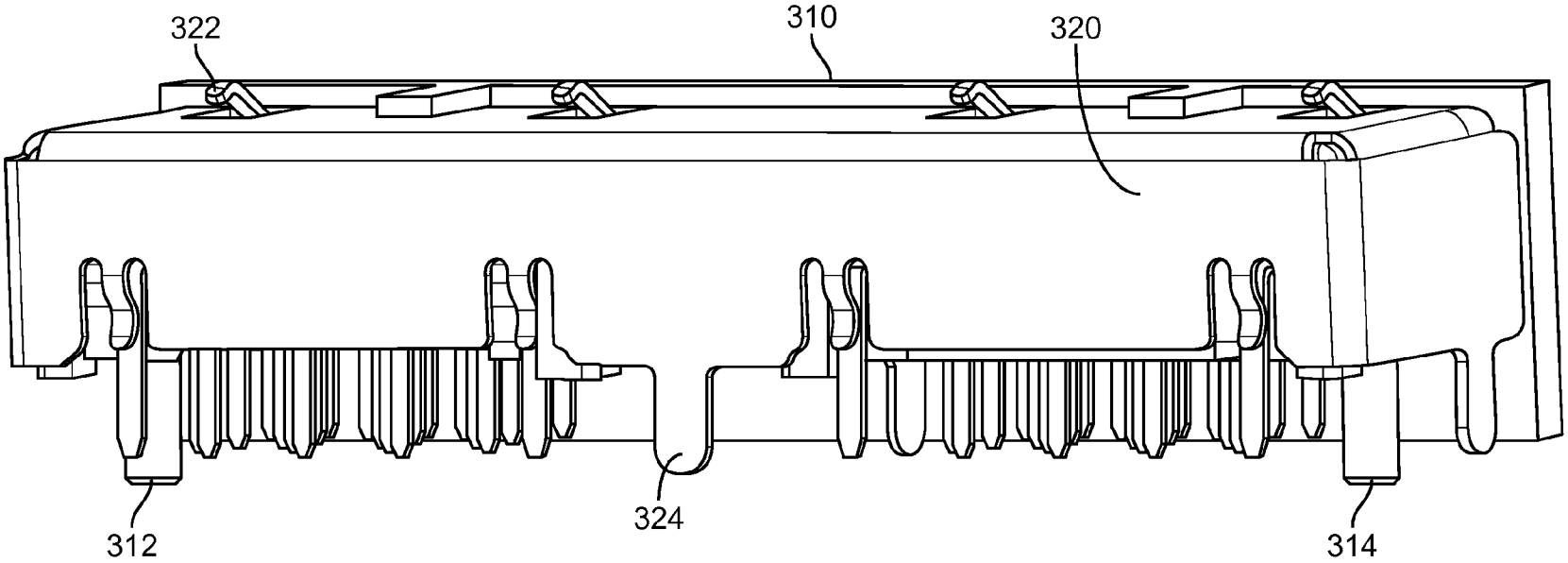
FIG. 4 illustrates a rear view of a connector receptacle assembly according to an embodiment of the present invention.

FIG. 4 illustrates a rear view of a connector receptacle assembly according to an embodiment of the present invention. Shell 320 may include one or more tabs 324. Tabs 324 may be soldered or otherwise fixed to a printed circuit board, flexible circuit board, or other appropriate substrate. Housing 310 may include one or more posts 312 and 314. Post 312 and 314 may be mechanically inserted into holes in the printed circuit board, flexible circuit board, or other appropriate substrate. As before, shell 320 may include one or more fingers 322 to form mechanical or electrical contact, or both, with a device enclosure.

In various embodiments of the present invention, the "footprint," that is the position of features such as posts 312 and 314, tabs 324, and contacts, such as contacts 140 and 142, may be arranged to be symmetrical. This symmetry may be such that the position of the features are stepped twice, or it may be that these features are mirrored. This symmetry may be useful in that a portion of a printed circuit board layout may be stepped or mirrored as well. This may speed the design process.

Figure 5:
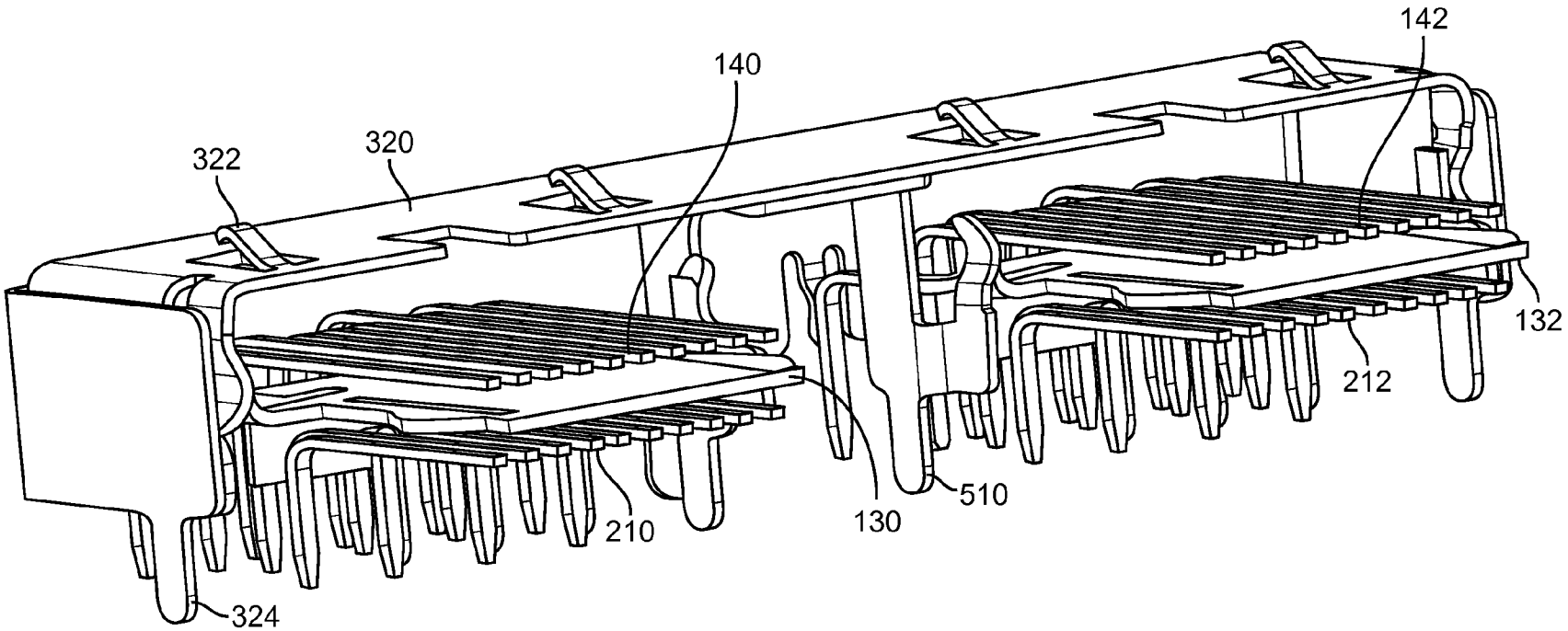
FIG. 5 illustrates a portion of a connector receptacle assembly according to an embodiment of the present invention.

FIG. 5 illustrates a portion of a connector receptacle assembly according to an embodiment of the present invention. In this example, a housing of the connector receptacle assembly has been removed. This connector receptacle assembly may provide two sets of contacts, each set of contacts for a single connector receptacle. Each set of contacts may include a top row of contacts 140 and 142 and a bottom row of contacts 210 and 212. These contacts are illustrated as being through-hole contacts, though in other embodiments of the present invention, some or all of these contacts may be surface mount contacts or other types of contacts.

Each row contacts 140 and 210, and 142 and 212, may be isolated or separated from each other by center a ground contacts 130 and 132. This may provide electrical isolation between contacts in these rows. Moreover, various signal contacts in these rows may be next to or near contacts that are grounded. This, when combined with shell 320, may provide isolation between signals such as differential pair lines. For example, a differential pair may be placed on adjacent contacts. Contacts on each side of differential pair may be grounded. When combined with shell 320 and center contact 130 or 132, a differential pair may experience less cross-talk from nearby signals, and may be protected from electromagnetic interference from other signals or circuitry. Also, this differential pair may provide less electromagnetic interference to other signals or circuitry.

Center ground contacts 130 and 132 may be joined by bridging piece 510. Bridging piece 510 and center contacts 130 and 132 may connect to each other and to shell 320. Shell 320 may include fingers 322 and tabs 324, as described above.

Figure 6:
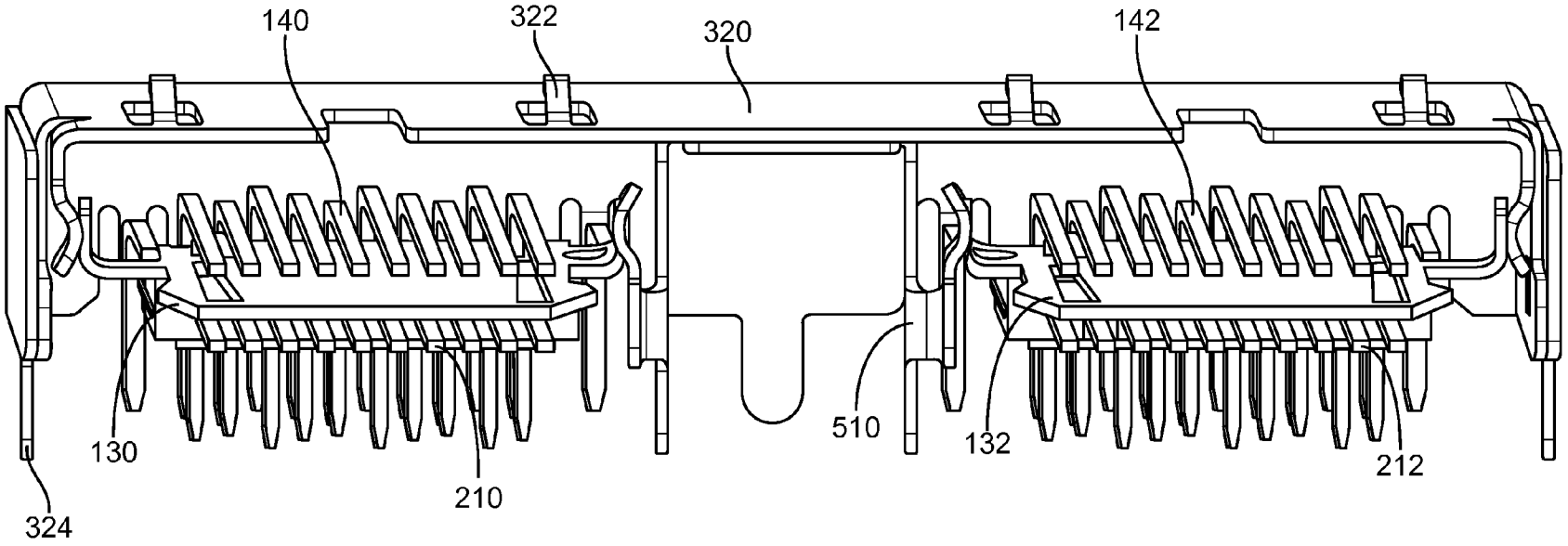
FIG. 6 illustrates another view of a portion of a connector receptacle assembly according to an embodiment of the present invention.

FIG. 6 illustrates another view of a portion of a connector receptacle assembly according to an embodiment of the present invention. Again, in this example, a housing has been removed. This connector receptacle assembly may provide two sets of contacts, each set of contacts for an individual connector receptacle. The sets of contacts may include a top row of contacts 140 and 142, and a bottom row of contacts 210 and 212. These rows of contacts may be isolated from each other by center ground contacts 130 and 132. Center ground contacts 130 and 132 may be joined by bridging piece 510. Center ground contacts 130 and 132 and bridging piece 510 may connect to each other and to shell 320. Shell 320 may include fingers 322 and tabs 324, as shown above.

Figure 7:
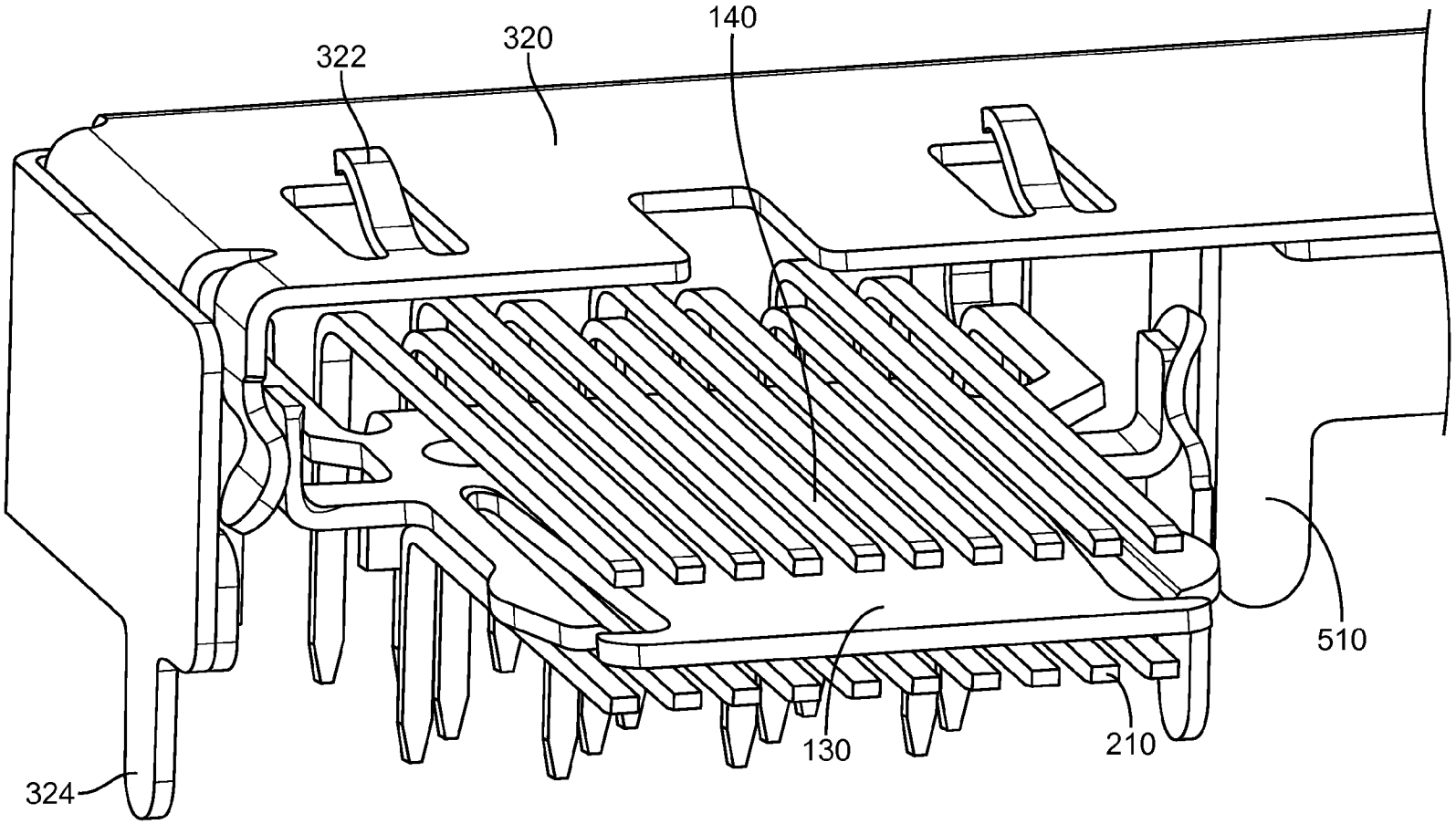
FIG. 7 illustrates a more detailed view of a portion of a connector receptacle assembly according to an embodiment of the present invention.

FIG. 7 illustrates a more detailed view of a portion of a connector receptacle assembly according to an embodiment of the present invention. This portion of a connector receptacle assembly may include a top row contacts 140 and a bottom row of contacts 210. The top row contacts 140 and bottom row of contacts 210 may be separated by center ground contacts 130. Center ground contact 130 may connect to shell 320 and bridging piece 510. Bridging piece 510 and center contact 130 may be formed of the same material, such as titanium copper, and they may be connected by laser or spot welding, soldering, or other appropriate manner. Shell 320 may include fingers 322 and tabs 324.

Figure 8:
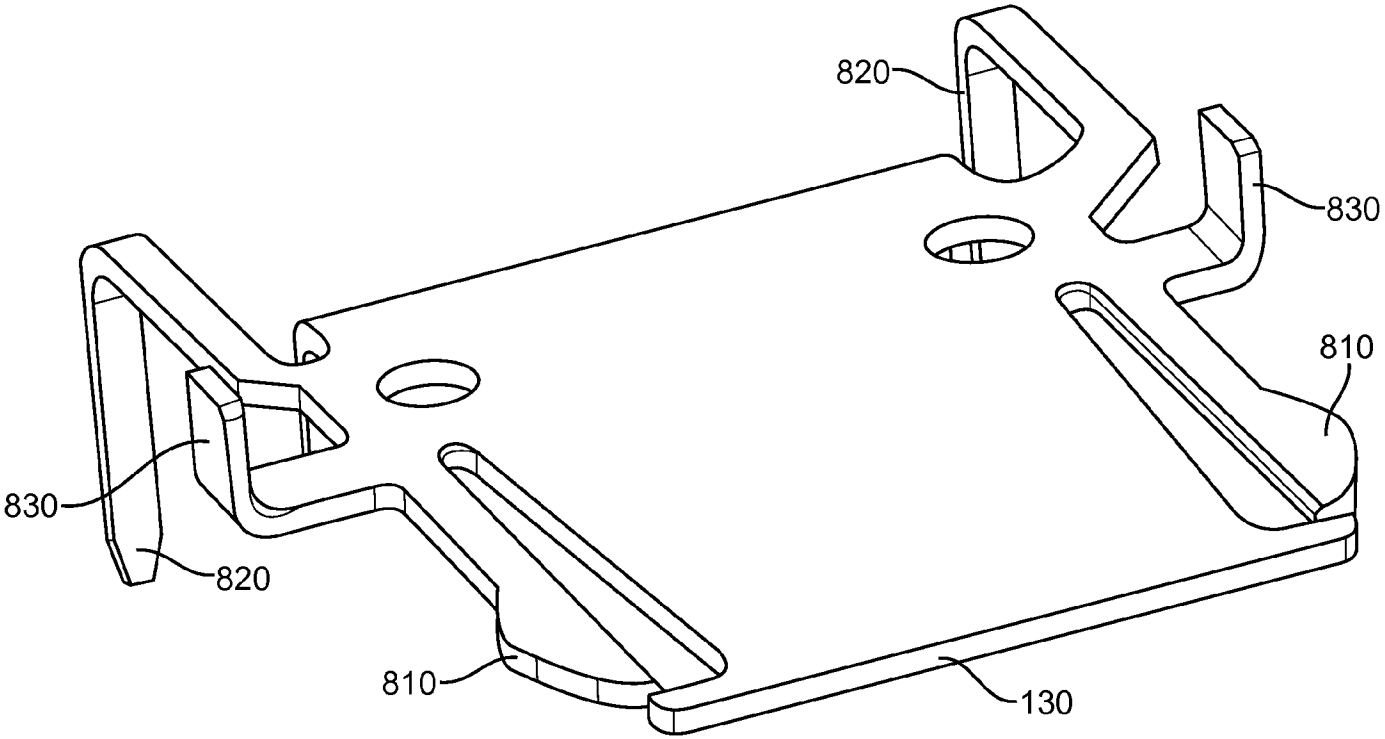
FIG. 8 illustrates a center contact according to an embodiment of the present invention.

FIG. 8 illustrates a center contact according to an embodiment of the present invention. This center contacts may be used to provide ground or isolation between rows of contacts in a connector receptacle. Center ground contact 130 may include side protrusions or contacts 810. Side protrusions or contacts 810 may emerge from sides of a tongue of a connector receptacle to form ground and retention features for the connector receptacle. Specifically, as a connector insert is inserted into the connector receptacle, sides of the connector insert shell may form an electrical connection with protrusions 810. Also, protrusions 810 may be pressed inward by the connector insert, such that protrusions 810 provide a retention force for the connector insert.

Center ground contact 130 may also include through-hole contact portions 820. Through-hole contact portions 820 may be soldered or otherwise fixed to a printed circuit board, flexible circuit board, or other appropriate substrate. Through-hole contacts 820 may form electrical connections with ground lines or plans in the appropriate substrate. In this specific example, through-hole contact portions 820 are shown as through-hole contacts, though in other embodiments of the present invention, they may be surface mount contacts or other types of contacts.

Again, to improve the retention force provided by protrusions 810, as well as to improve durability of center contact 130, center contact 130 may be formed of titanium copper or other appropriate material. When shell 320 (not shown) is formed of stainless steel, center contact 130, being made of titanium copper, may not laser solder well to shell 320. That is because such techniques do not form adequate connections between these disparate materials. Accordingly, embodiments of the present invention may employ mechanical means to form electrical connections between center contact 130 and shell 320. Specifically, tabs 830 may be provided to form electrical connections with shell 320. Examples are shown in the following figures.

Figure 9:
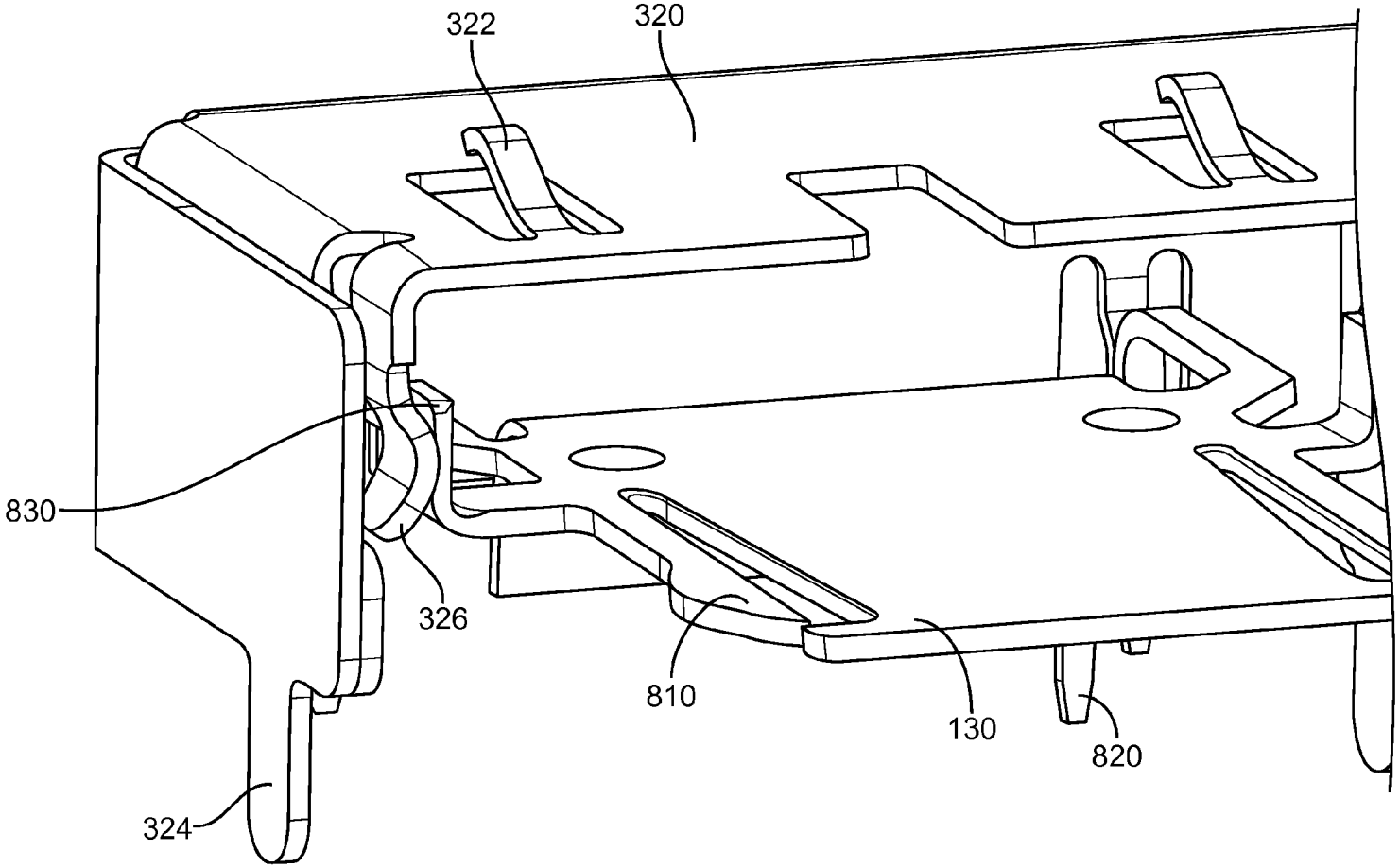
FIG. 9 illustrates a portion of a connector receptacle assembly according to an embodiment of the present invention.

FIG. 9 illustrates a portion of a connector receptacle assembly according to an embodiment of the present invention. In this figure, center contact 130 may be electrically connected to shell 320. Specifically, tab 830 is placed against bend 326 in shell 320. Bend 326 may be biased to retain force against tabs 830 to maintain an electrical connection between center contact 130 and shell 320. Shell 320 may include fingers 322 and tabs 324, as before. Center contact 130 may include protrusions 810 and through-hole contact portions 820.

Figure 10:
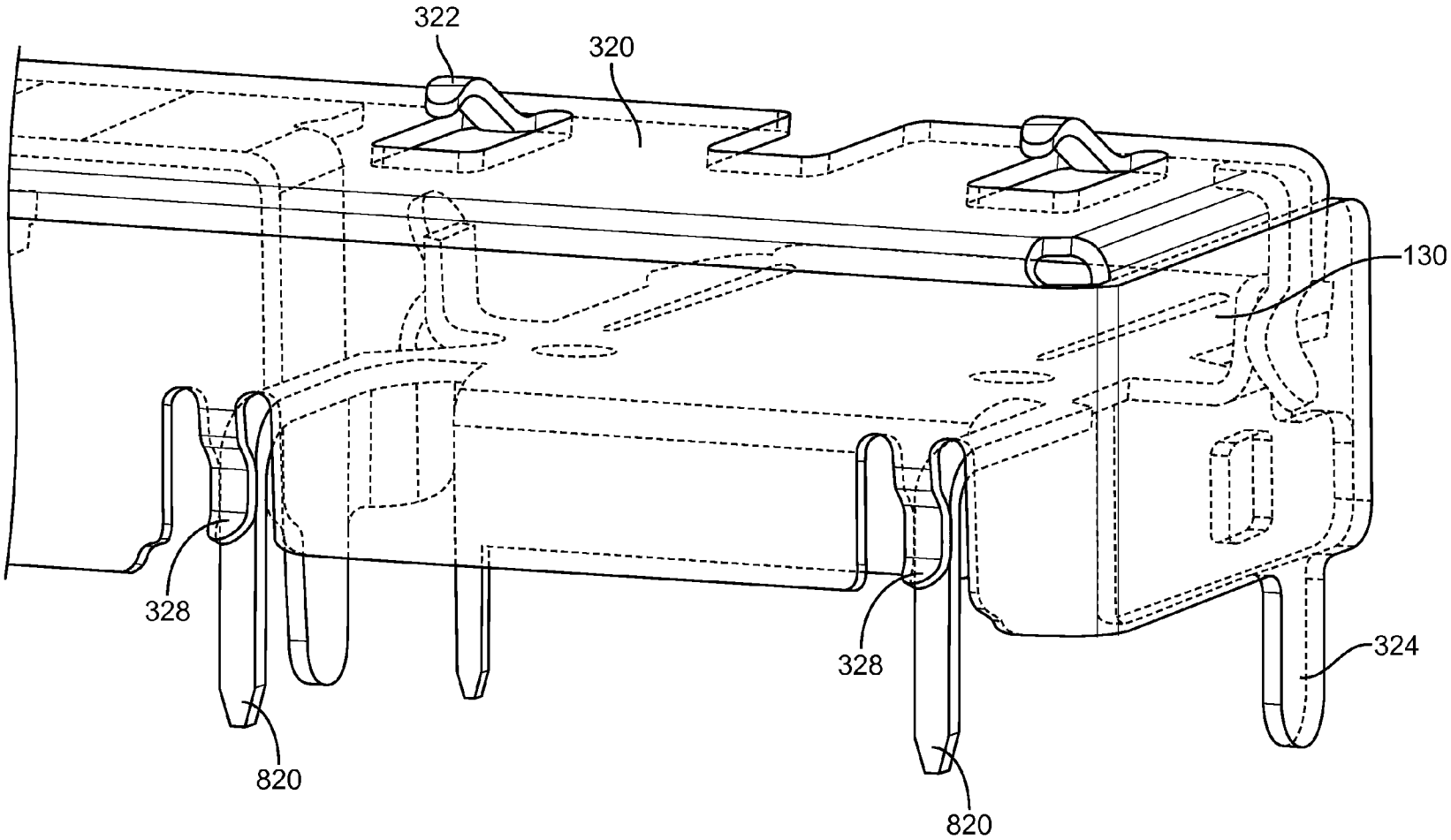
FIG. 10 illustrates a portion of a connector receptacle assembly according to an embodiment of the present invention.

FIG. 10 illustrates a portion of a connector receptacle assembly according to an embodiment of the present invention. Again, in this figure, center contact 130 may be in electrical contact with shell 320. Specifically, bends 328 are formed in shell 320 to press against through-hole contact portions 820, thereby maintaining the electrical connection. Shell 320 may include fingers 322 and tabs 324, as before.

Again, in the above examples, ground and retention features may be included as part of a device enclosure. In other embodiments of the present invention, ground and retention features may be formed as part of, or attached to, a shield that is attached to a housing. The following figures illustrate a method of assembling a connector receptacle where ground and retention features are attached to a shield and housing.

Figure 11:
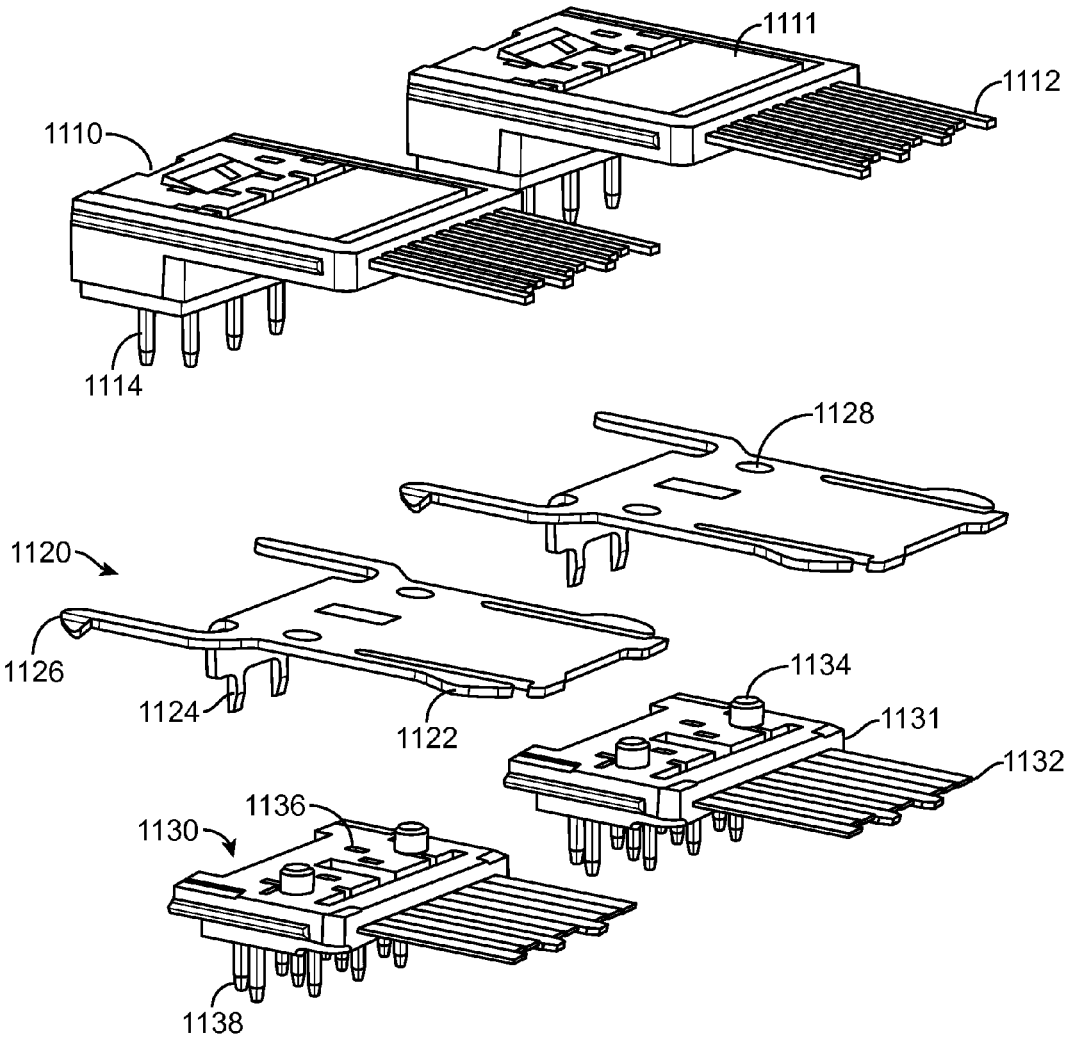
FIG. 11 illustrates a pair of first subassemblies, a pair of center ground contacts, and a pair of second subassemblies according to an embodiment of the present invention.

FIG. 11 illustrates a pair of first subassemblies, a pair of center ground contacts, and a pair of second subassemblies according to an embodiment of the present invention. Each first subassembly 1110 may include contacts 1112 having through-hole portions 1114. Through-hole portions 1114 may be soldered or otherwise fixed to through-holes in a printed circuit board, flexible circuit board, or other appropriate substrate. First subassemblies 1110 may be formed by injection molding housing portions 1111 around contacts 1112. In other embodiments, contacts 1112 may be inserted into housing 1111. In other embodiments of the present invention, housing 1111 may be formed of multiple pieces the snap or otherwise are fixed together around contacts 1112.

Center ground contacts 1120 may include side ground contacts 1122, through-hole contact portions 1124, and opening 1128. As before, center ground contacts 1120 may be formed using copper, titanium-copper, or other appropriate material.

Second subassemblies 1130 may include contacts 1132, posts 1134, and holes or passages 1136. Contacts 1132 may have through-hole portions 1138. As before, through-hole portions 1138 may be soldered or otherwise fixed to through-holes in a printed circuit board, flexible circuit board, or other appropriate substrate. Also, while the contacts in this example are shown as having through-hole portions, other embodiments of the present invention may have other types of connecting portions, such as surface-mount portions.

Center ground contacts 1120 may be fixed a relative to second subassemblies 1130 by aligning openings 1128 with posts 1134. First subassemblies 1110 may be aligned to second subassemblies 1130 by placing through-hole portions 1114 into openings 1136.

The assembled subassemblies and ground contacts may then be inserted into a housing. An example is shown in the following figure.

Figure 12:
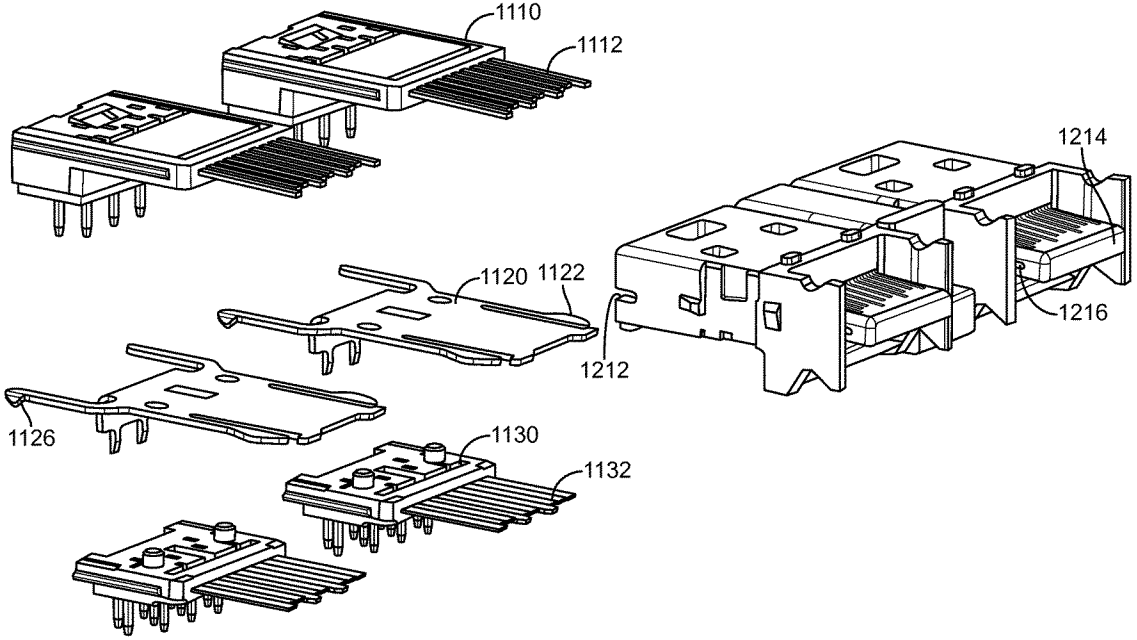
FIG. 12 illustrates portions of a connector receptacle according to an embodiment of the present invention.

FIG. 12 illustrates portions of a connector receptacle according to an embodiment of the present invention. Again, first subassemblies 1110, center ground contacts 1120, and second subassemblies 1130 may be assembled together. These combined assemblies may be inserted into a back of housing 1210. Side ground contact us 1122 may emerge from openings 1216 in tongue 1214 of housing 1210. Contacts 1112 and 1132 may be available at openings on tops and bottoms of tongues 1214. Tabs 1126 may fit in notches 1212 in housing 1210.

Again, embodiments of the present invention may employ ground and retention features that are attached to a shield. An example is shown in the following figures.

Figure 13:
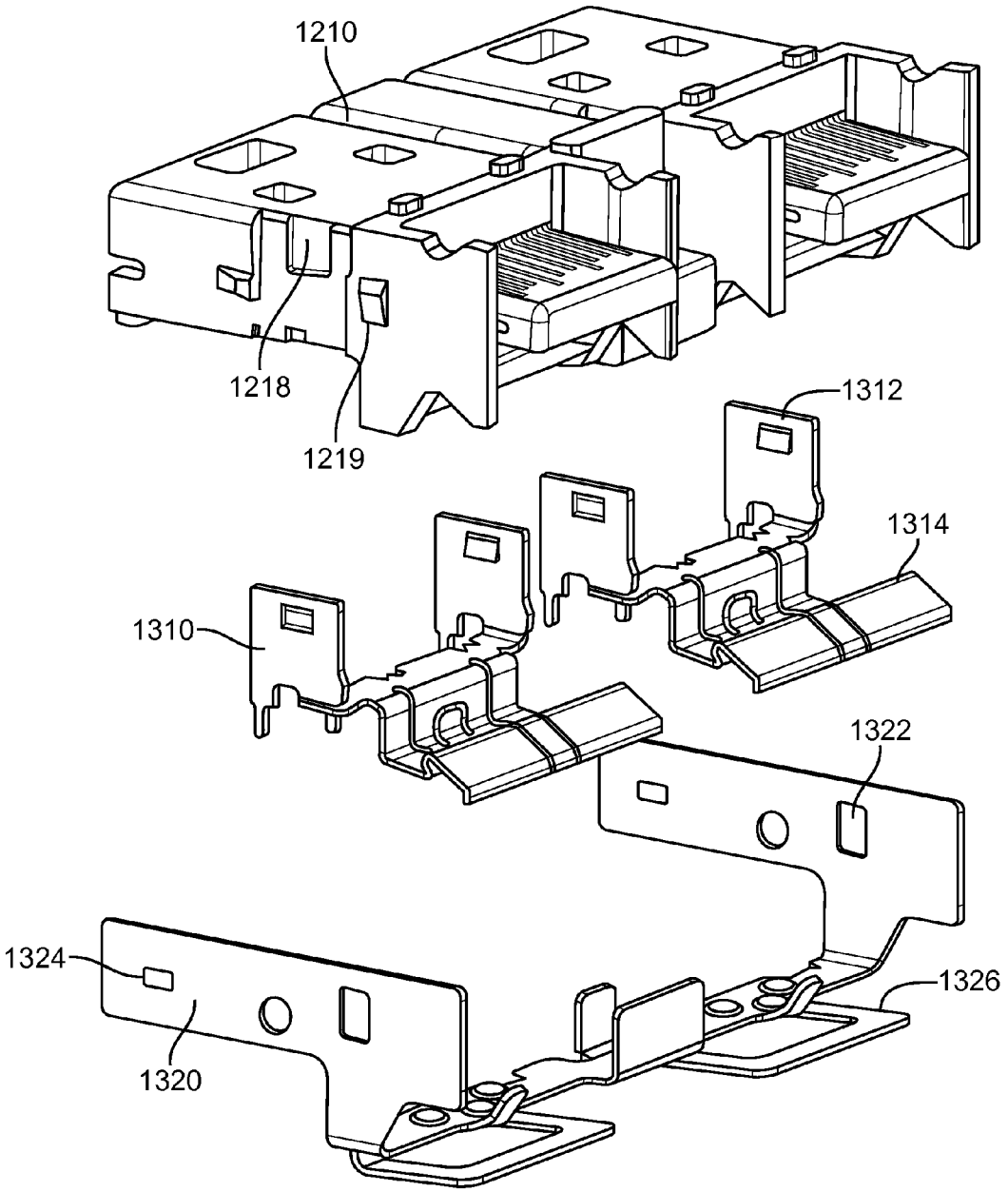
FIG. 13 illustrates ground and retention features for a connector receptacle according to an embodiment of the present invention.

FIG. 13 illustrates ground and retention features for a connector receptacle according to an embodiment of the present invention. In this example, ground and retention features 1310 and 1320 attached to housing 1210. Specifically, notches 1312 in ground and retention feature 1310 align with slots 1218 on housing 1210. Ground contacts 1314 may act as part of a ground path when a connector insert is connected into the connector receptacle. Ground contacts 1314 may also provide retention for the connector insert. Opening 1322 on ground feature 1320 may align with tab 1219 on housing 1210. Ground contacts 1326 may be soldered to or otherwise fixed to ground contacts on a printed circuit board, flexible circuit board, or other appropriate substrate.

Figure 14:
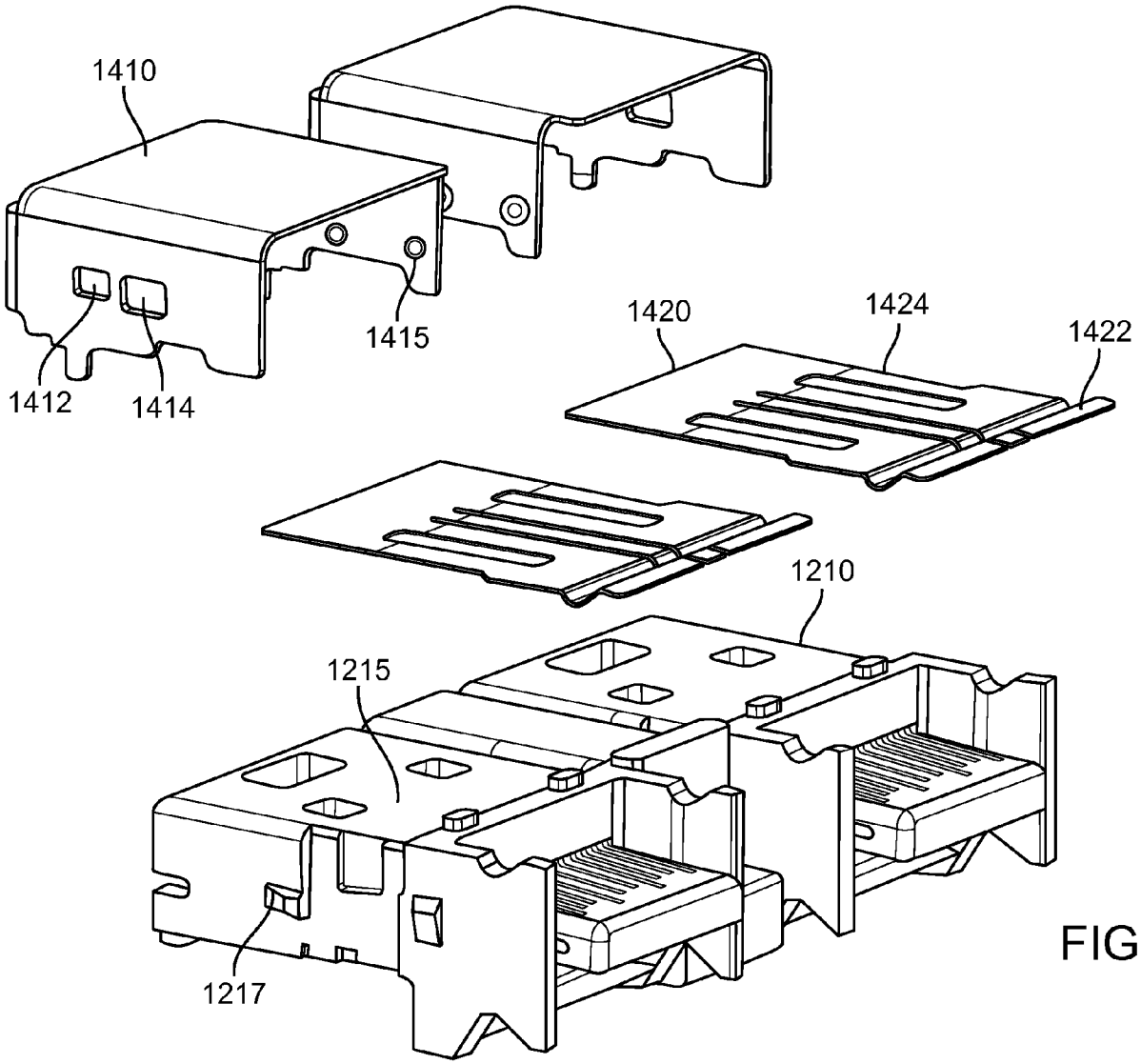
FIG. 14 illustrates further ground and retention features for a connector receptacle according to an embodiment of the present invention.

FIG. 14 illustrates further ground and retention features for a connector receptacle according to an embodiment of the present invention. In this example, ground and retention features 1420 may include openings 1424 that aligned with tabs 1215 on housing 1210. Ground and retention features 1422 may act in conjunction with ground and retention features 1314 in FIG. 13 to provide a ground path and retention for a connector insert when a connector insert is inserted into the connector receptacle. Opening 1414 on a shield 1410 may aligned with tab 1217 on housing 1210. Shield 1410 may further include tab 1416, which may be grounded at the printed circuit board, flexible circuit board, or other appropriate substrate. Shield portion 1410 may be spot or laser welded, or otherwise fixed to ground and retention feature 1310 at points 1415.

Figure 15:
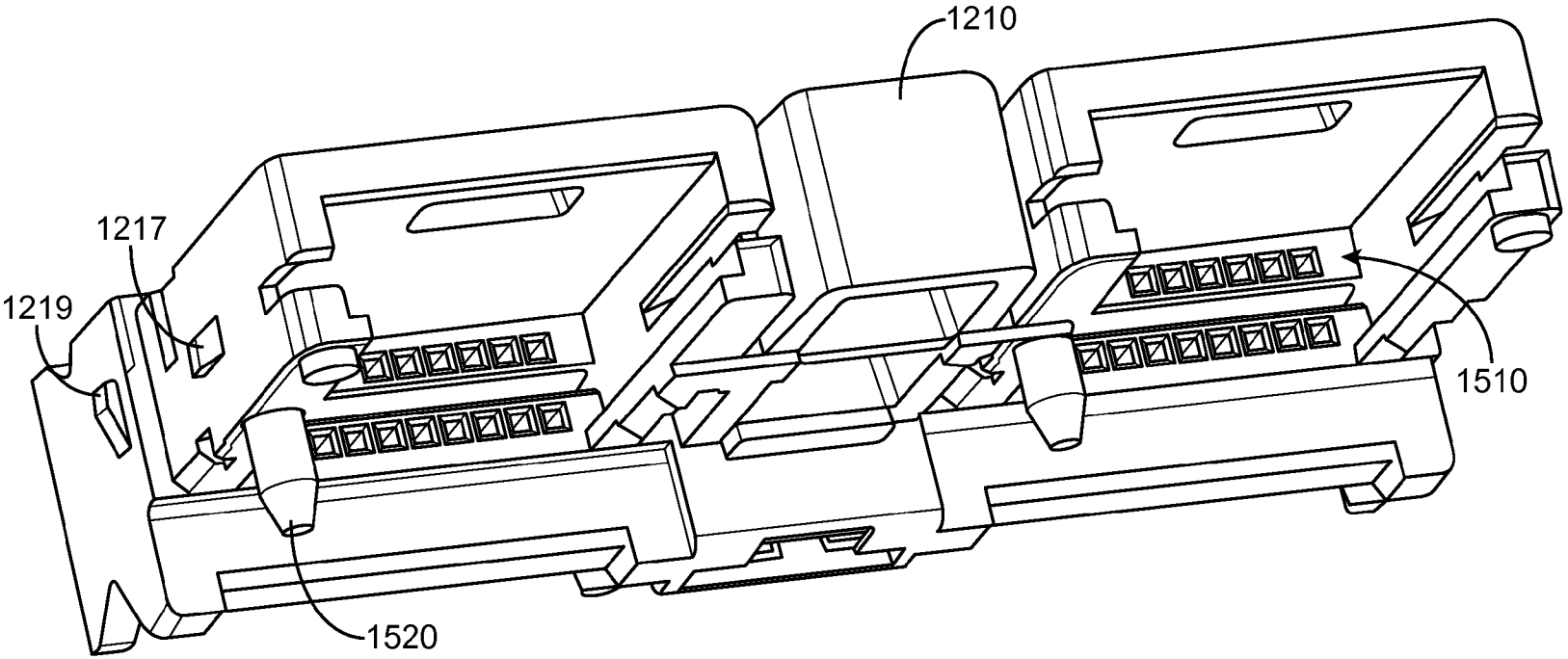
FIG. 15 illustrates a more detailed view of a back of a housing for a pair of connector receptacles according to an embodiment of the present invention.

FIG. 15 illustrates a more detailed view of a back of a housing for a pair of connector receptacles according to an embodiment of the present invention. Housing 1210 may include posts 1520 to attach to a main-logic board or other appropriate substrate to provide mechanical support for the connector receptacles. Housing 1210 may include openings 1510 for subassemblies 1110 and 1130, and ground contacts 1120, as shown in FIG. 11.

Figure 16:
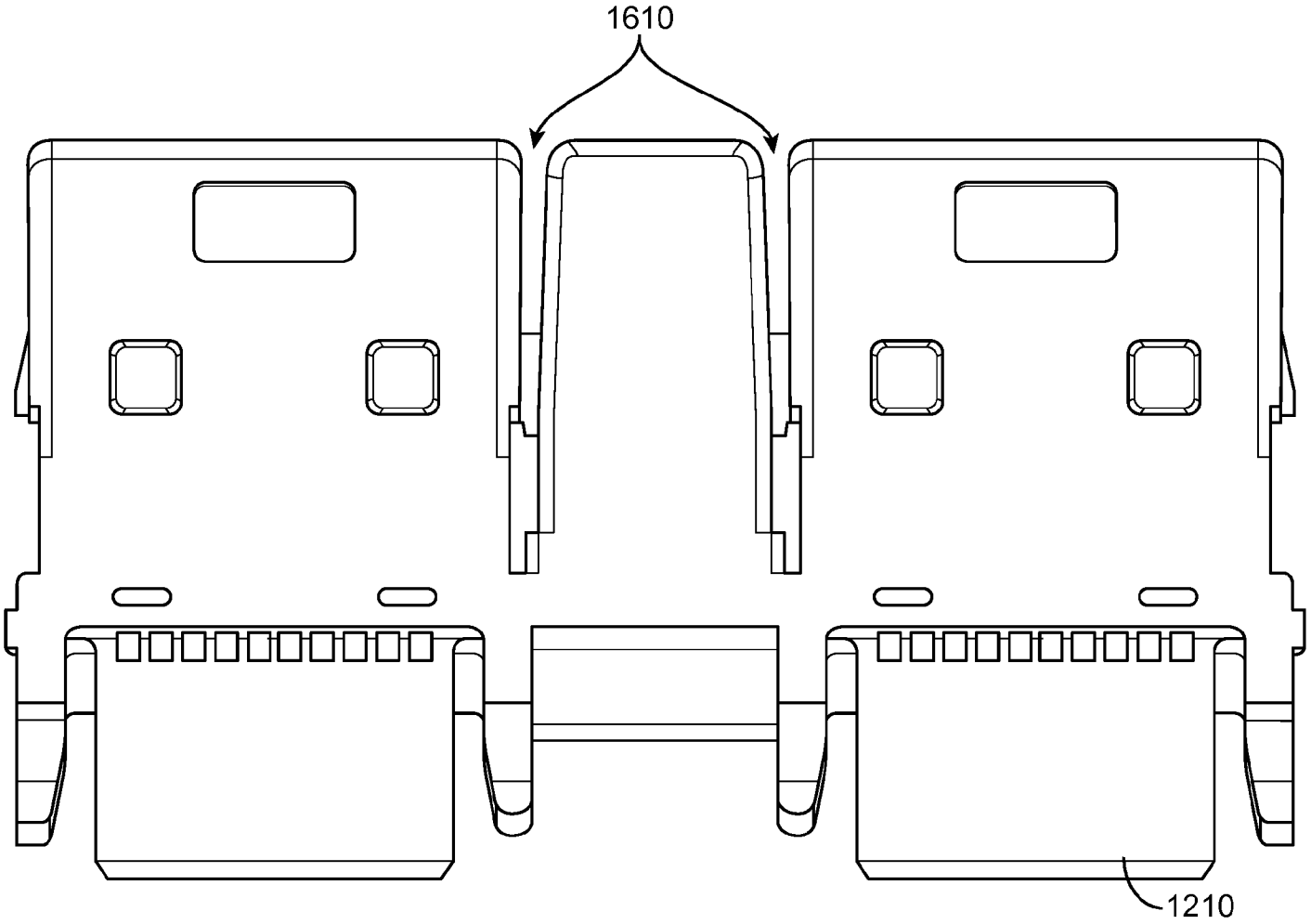
FIG. 16 illustrates a top view of a housing for a pair of connector receptacles according to an embodiment of the present invention.

FIG. 16 illustrates a top view of a housing for a pair of connector receptacles according to an embodiment of the present invention. Housing 1210 may include openings 1610. Portions of shells or shields 1410 and ground and retention features 1312 may fit in openings 1610.

Again, in various embodiment of the present invention, central ground contacts 1120 may be formed titanium copper. These central ground contacts 1120 may be difficult to electrically connect to a shell or shield portion that may be formed of stainless steel. Accordingly, embodiments of the present invention may rely on a compression to form contacts between the central ground contacts 1120 and shield portion 1410. An example is shown in the following figure.

Figure 17:
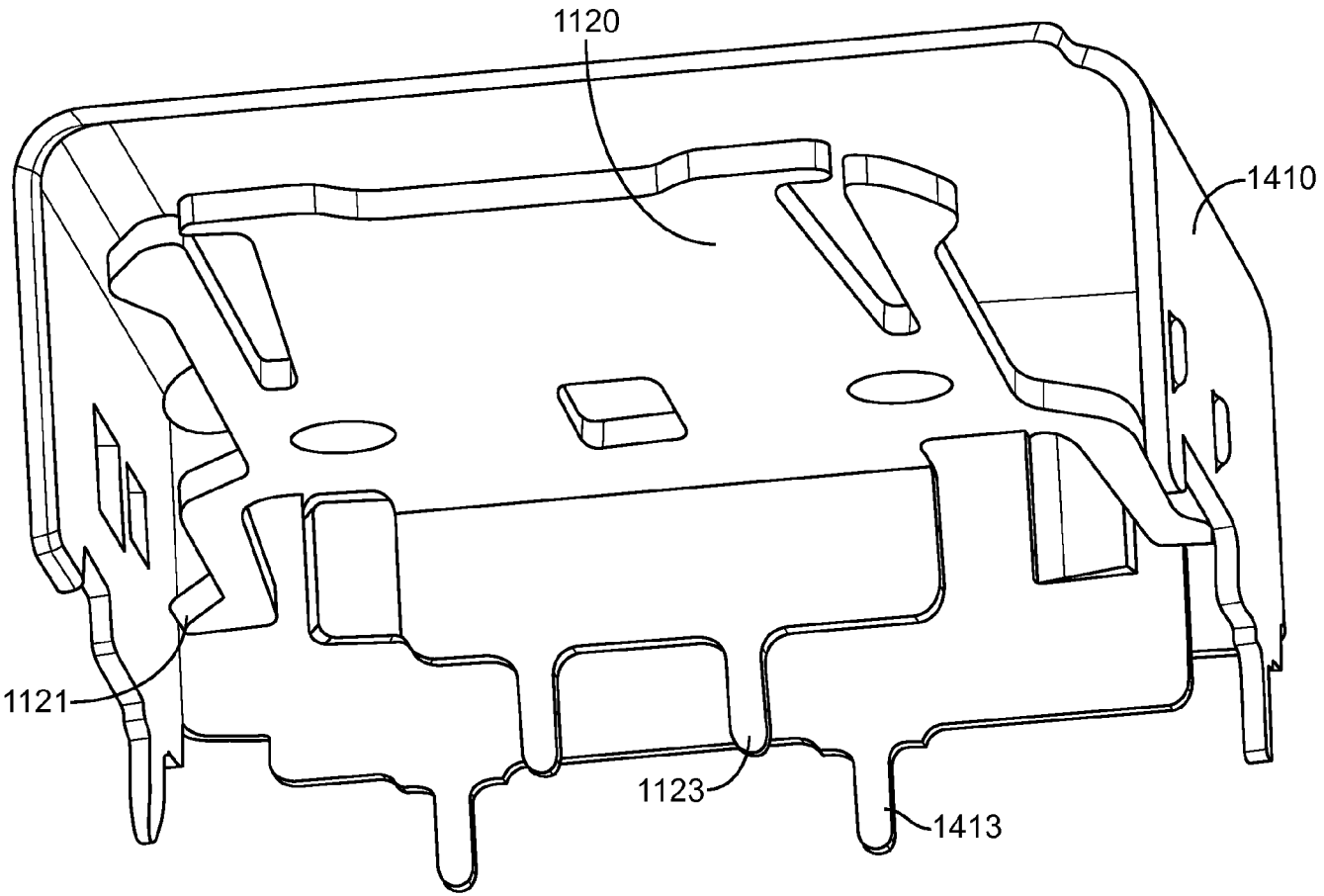
FIG. 17 illustrates a center ground contact contacting a shield portion according to an embodiment of the present invention.

FIG. 17 illustrates a center ground contact contacting a shield portion according to an embodiment of the present invention. Specifically, points 1122 of central ground contact 1120 is in physical contact with an inside of shield portion 1410. This contact may stay in place through the compression of points 1122 of center ground contact 1120. Center ground contact 1120 may include ground tabs 1123, which may be soldered to a ground contact on a main-logic board or other appropriate substrate. Shield portion 1410 may include tabs 1413, also may be soldered to a ground contact on a main-logic board or other appropriate substrate. In this way, center ground contact 1120 and shield portion 1410 may connect to each other through traces on a main-logic board or other appropriate substrate.

Figure 18:
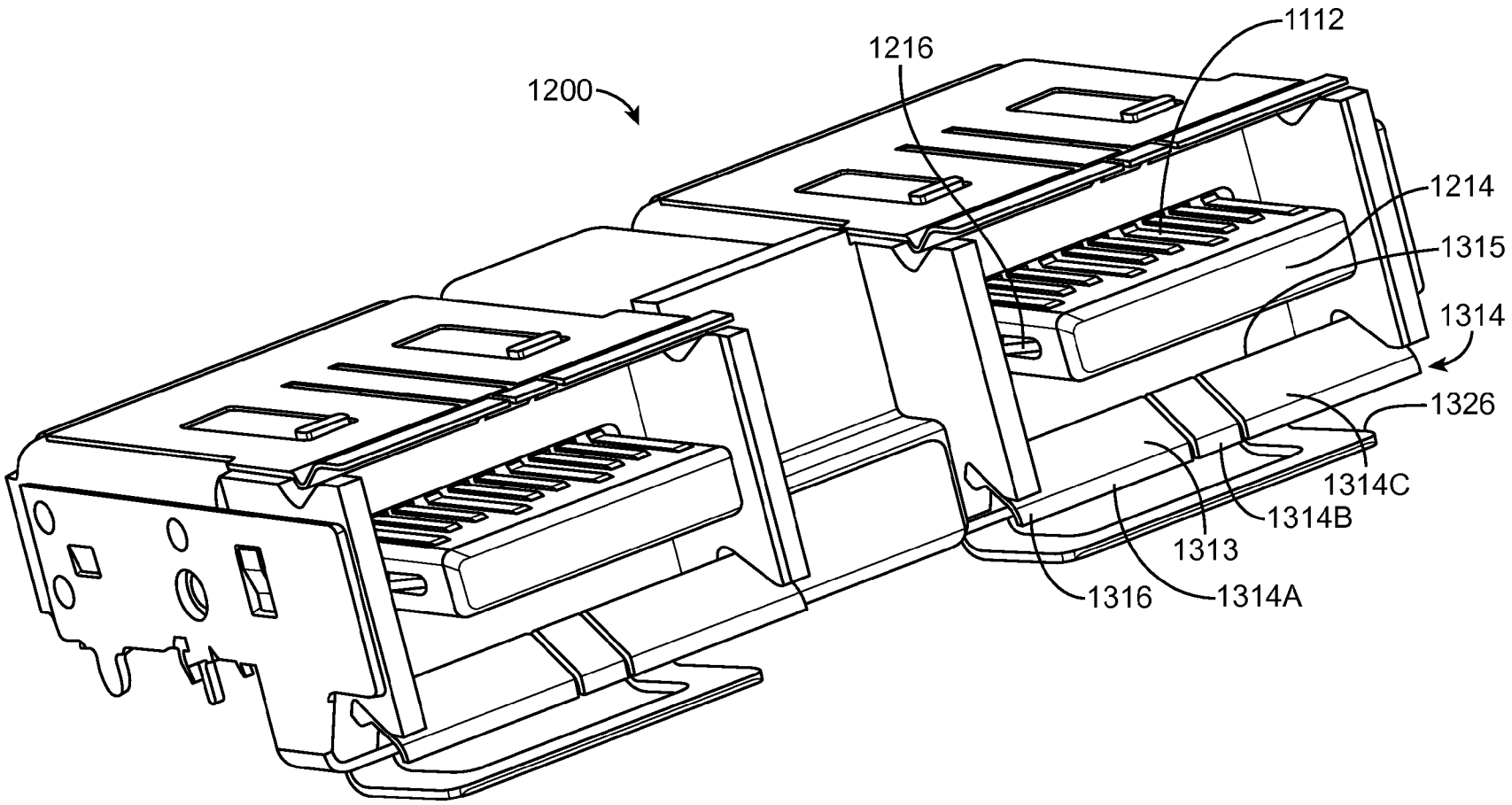
FIG. 18 illustrates a completed pair of connector receptacles according to an embodiment of the present invention.

FIG. 18 illustrates a completed pair of connector receptacles according to an embodiment of the present invention. These connector receptacles 1200 may include tongues 1214 having side ground contacts 1216. Contacts 1112 may reside on a top of tongue 1214, while contacts 1132 (not shown), may reside on a bottom of tongue 1214.

Connector receptacles 1200 may include ground contacts 1314. Ground contacts 1314 may be used in place of dimpled ground contacts 150 in FIG. 1. Specifically, dimpled ground contacts, such as dimpled ground contact 150 in FIG. 1, may be arranged to fit in a pocket in a shield of a connector insert. This arrangement may provide a retention force for the connector insert. However, a dimpled ground contact may lose contact with a shield of the connector insert, for example, if it resides in a center of the pocket on the shield of the connector insert. This loss of a ground connection may lead to an increase in ground noise, with a resulting interference with proper signal transmission through the connector. Moreover, a dimpled contact may provide a sharp point. This sharp point may mar or cut a groove in the plug or connector insert over time. Also, a dimpled contact may provide only a single contact point to ground between the connector receptacle 1200 and connector insert.

Accordingly, embodiments of the present invention may employ ground contacts 1314. Ground contacts 1314 may be split into contact portions 1314A, 1314B, and 1314C. By splitting ground contacts 1314 in this way, several points along ground contact 1314 may make contact with a shield of a connector insert. Also, ground contact portion 1314B may be arranged to fit in an opening or pocket in the connector insert shield, thereby providing a retention force. Ground contacts portions 1314A, 1314B, and 1314C may be split by very fine separations to provide an attractive appearance for the connector receptacle. Ground contacts 1314 may provide a smoother edge for a connector insert in order to help avoid marring of the connector insert. Ground contact 1314 may be connected to a first shell portion or ground feature 1320.

Ground contact 1314 may be located under tongue 1214. The ground contact may have a front sloping portion 1313, where the front sloping portion 1313 slopes from a front bottom of the connector receptacle 1200 upwards to a back of the connector receptacle 1200. The front sloping portion 1313 may form a ridge 1315 that may contact a shield of a connector insert when the connector insert is inserted into connector receptacle 1200. The front sloping portion 1313 may have a downward, tapered bottom edge 1316. This downward, tapered bottom edge 1316 may help to prevent the ground contact 1314 from becoming snagged and damaged when the connector insert is inserted into connector receptacle 1200.

Ground contacts 1326 may rest on a frame, device enclosure, main-logic board, or other appropriate substrate. In various embodiments of the present invention, ground contacts 1326 may be insulated to keep noise at connector receptacle 1200 from coupling onto the device enclosure.

It may be desirable to protect the contacts of this connector receptacle unit when it is in transit or being handled. Accordingly, a cover or protective piece may be used. An example is shown in the following figure.

Figure 19:
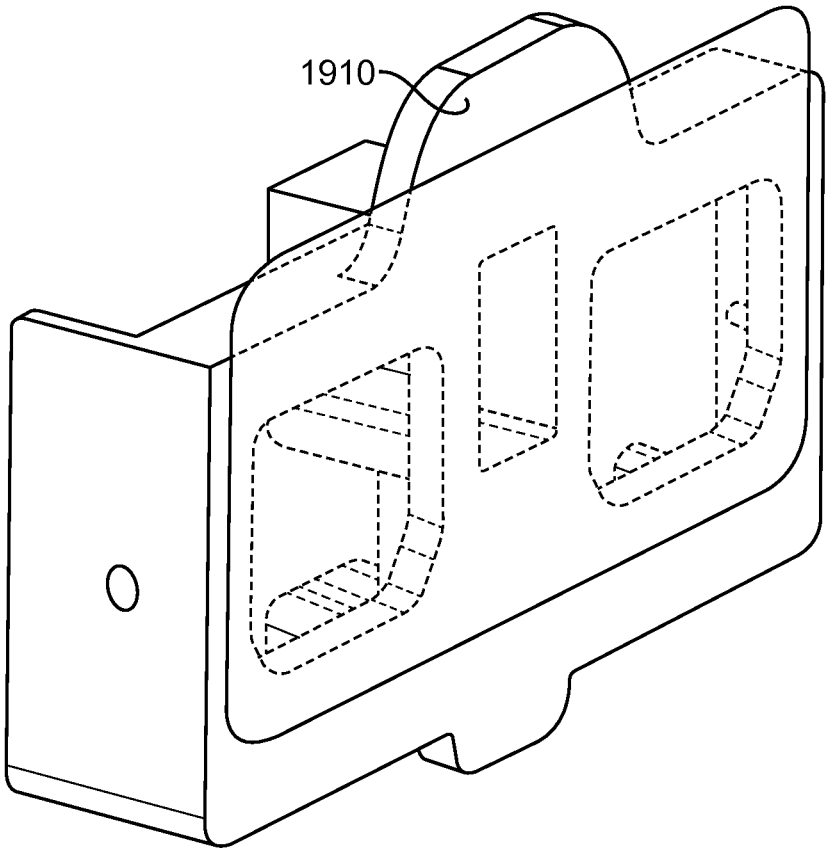
FIG. 19 illustrates a cover or protective piece that may be used to protect contacts on a connector receptacle according to an embodiment of the present invention.

FIG. 19 illustrates a cover or protective piece 1910 that may be used to protect contacts on a connector receptacle according to an embodiment of the present invention.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector receptacle assembly comprising:

a housing having a longitudinal axis and a first tongue and a second tongue, each of the first and second tongues extending side-by-side and extending in a direction orthogonal to the longitudinal axis, the first tongue and the second tongue each comprising:

a top row of contacts positioned along a top side of the tongue;

a bottom row of contacts positioned along a bottom side of the tongue; and a center around contact positioned in a center of the tongue and between the top row of contacts and the bottom row of contacts, the center ground contact comprising a center portion, a first side contact extending away from and parallel to the center portion, the first side contact extending through a first opening in a first side of the tongue, and a second side contact extending away from and parallel to the center portion, the second side contact extending through a second opening in a second side of the tongue.

2. The connector receptacle assembly of claim 1 wherein the center ground contact is formed of titanium-copper.

3. The connector receptacle assembly of claim 2 further comprising a shell at least partially surrounding a top, sides, and back of the housing, wherein the shell is formed of stainless steel.

4. The connector receptacle assembly of claim 3 wherein the housing is formed of a nonconductive material.

5. The connector receptacle assembly of claim 4 wherein the housing is plastic.

6. The connector receptacle assembly of claim 4 wherein the top row of contacts and the bottom row of contacts are arranged to carry signals for DisplayPort.

7. The connector receptacle assembly of claim 4 wherein the top row of contacts and the bottom row of contacts are arranged to carry signals for Thunderbolt.

8. A connector receptacle assembly comprising:

a housing having a first tongue and a second tongue, the first tongue and the second tongue each comprising:

a top row of contacts positioned along a top side of the tongue;

a first housing portion molded around a portion of each contact in the top row of contacts;

a bottom row of contacts positioned along a bottom side of the tongue;

a second housing molded portion around a portion of each contact in the bottom row of contacts; and a center around contact positioned in a center of the tongue and between the top row of contacts and the bottom row of contacts, the center around contact comprising a center portion, a first side contact extending away from and parallel to the center portion, the first side contact extending through a first opening in a first side of the tongue, and a second side contact extending away from and parallel to center portion, the second side contact extending through a second opening in a second side of the tongue; and a shell at least partially surrounding a top, sides, and back of the housing.

9. The connector receptacle assembly of claim 8 wherein the center ground contact is formed of titanium-copper.

10. The connector receptacle assembly of claim 9 wherein the shell is formed of stainless steel.

11. The connector receptacle assembly of claim 10 wherein the housing is formed of a nonconductive material.

12. The connector receptacle assembly of claim 11 wherein the housing is plastic.

13. The connector receptacle assembly of claim 11 wherein the top row of contacts and the bottom row of contacts are arranged to carry signals for DisplayPort.

14. The connector receptacle assembly of claim 11 wherein the top row of contacts and the bottom row of contacts are arranged to carry signals for Thunderbolt.

15. A connector receptacle assembly comprising:

a housing having a first tongue and a second tongue, the first tongue and the second tongue each comprising:

a first subassembly having a first subassembly housing molded around a portion of each contact in a top row of contacts, the top row of contacts positioned along a top side of the tongue;

a second subassembly having a second subassembly housing molded around a portion of each contact in a bottom row of contacts, the bottom row of contacts positioned along a bottom side of the tongue; and a center ground contact positioned in a center of the tongue and between the top row of contacts and the bottom row of contacts, the center ground contact comprising a center portion, a first side contact at extending away from and parallel to the center portion, the first side contact extending through a first opening in a first side of the tongue, and a second side contact at extending away from and parallel to the center portion, the second side contact extending through a second opening in a second side of the tongue, wherein the first side contact, the second side contact, and the center portion of the center ground contact are a single piece; and a shell at least partially surrounding a top, sides, and back of the housing.

16. The connector receptacle assembly of claim 15 wherein the center ground contact is formed of titanium-copper.

17. The connector receptacle assembly of claim 16 wherein the shell is formed of stainless steel.

18. The connector receptacle assembly of claim 17 wherein the housing is formed of a nonconductive material.

19. The connector receptacle assembly of claim 17 wherein the housing is plastic.

20. The connector receptacle assembly of claim 19 wherein the top row of contacts and the bottom row of contacts are arranged to carry signals for Thunderbolt.

* * * * *